US011794232B1

(12) United States Patent
Mears

(10) Patent No.: US 11,794,232 B1
(45) Date of Patent: Oct. 24, 2023

(54) TOOL FOR CURVING STRUCTURAL FRAMING COMPONENTS

(71) Applicant: SIMPSON STRONG-TIE COMPANY INC., Pleasanton, CA (US)

(72) Inventor: Charles Mears, White Bear Lake, MN (US)

(73) Assignee: SIMPSON STRONG-TIE COMPANY INC., Pleasanton, CA (US)

( * ) Notice: Subject to any disclaimer, the term of this patent is extended or adjusted under 35 U.S.C. 154(b) by 553 days.

(21) Appl. No.: 15/977,339

(22) Filed: May 11, 2018

Related U.S. Application Data

(60) Provisional application No. 62/504,714, filed on May 11, 2017.

(51) Int. Cl.

| | |
|---|---|
| ***B21D 5/02*** | (2006.01) |
| ***E04B 2/58*** | (2006.01) |
| ***B21D 11/20*** | (2006.01) |
| ***B21D 11/22*** | (2006.01) |

(52) U.S. Cl.
CPC ..... *B21D 5/0281* (2013.01); *B21D 11/20* (2013.01); *B21D 11/203* (2013.01); *B21D 11/22* (2013.01); *E04B 2/58* (2013.01); *E04B 2103/06* (2013.01)

(58) Field of Classification Search
CPC ..... B21D 17/00; B21D 17/02; B21D 47/01; Y10T 29/49625; Y10T 29/49627; B21D 5/0281; E04B 2/58; E04B 2103/06; B21D 5/0209; B21D 5/0254; B21D 11/20; B21D 11/203; B21D 11/22; B21D 13/10; B21D 13/02; B21D 22/04; B21D 7/06; B21D 7/063; B21D 37/04; B21D 9/14; B21D 47/00; B23P 17/02; B23P 2700/08; B23P 15/00
USPC ..... 72/372
See application file for complete search history.

(56) References Cited

U.S. PATENT DOCUMENTS

| | | | |
|---|---|---|---|
| 1,066,804 | A | 7/1913 | Falk |
| 1,284,993 | A | 11/1918 | Bellman |
| 1,729,556 | A | 9/1929 | Spear |
| 1,866,426 | A | 7/1932 | Siegrist |
| 2,313,270 | A | 3/1943 | Sapp |
| 2,591,649 | A | 4/1952 | Whiting |
| 2,592,679 | A | 4/1952 | Gedde |

(Continued)

FOREIGN PATENT DOCUMENTS

| | | | |
|---|---|---|---|
| FR | 796806 | | 4/1936 |
| WO | 1998043777 | A1 | 10/1998 |

*Primary Examiner* — Shelley M Self
*Assistant Examiner* — Teresa A Guthrie
(74) *Attorney, Agent, or Firm* — BUCHALTER; Cecily Anne O'Regan

(57) ABSTRACT

A system for shaping a workpiece, which may be in the form of a structural framing component, includes a tool with first and second indenting blades for indenting the workpiece as driven by a blade control apparatus. The workpiece is supported at the tool by one or more workpiece support modules that are each selectively and removably securable to the tool. A base plate is provided at the tool for removably securing the workpiece support modules to the tool without having to detach the tool from a platform of substructure. The workpiece support modules may therefore be quickly replaced to coordinate with workpieces of various size and shape.

16 Claims, 19 Drawing Sheets

(56) References Cited

U.S. PATENT DOCUMENTS

| | | | | |
|---|---|---|---|---|
| 2,826,106 | A | 3/1958 | Schegulla | |
| 3,063,313 | A | 11/1962 | Ustin | |
| 3,423,984 | A | 1/1969 | Keymer | |
| 3,738,150 | A | 6/1973 | Holmes et al. | |
| 4,140,000 | A | 2/1979 | Ehmann | |
| 4,177,664 | A | 12/1979 | Spors | |
| 4,488,425 | A | 12/1984 | Meikle | |
| 4,793,225 | A | 12/1988 | Berkich | |
| 4,875,274 | A | 10/1989 | Foster | |
| 5,247,769 | A | 9/1993 | Becker | |
| 5,249,445 | A | 10/1993 | Morello | |
| 5,263,355 | A | 11/1993 | Malagnoux | |
| 5,359,871 | A | 11/1994 | Morello | |
| 5,584,198 | A | 12/1996 | Morello et al. | |
| 5,584,200 | A | 12/1996 | Andersen | |
| 5,655,282 | A | 8/1997 | Hodek et al. | |
| 6,035,691 | A * | 3/2000 | Lin et al. | A61B 17/8863 72/212 |
| 6,138,359 | A * | 10/2000 | Mears | B21D 9/14 29/897.312 |
| 6,164,107 | A | 12/2000 | Korba, Jr. | |
| 7,866,112 | B2* | 1/2011 | Edmondson | E04B 1/24 52/633 |
| 2009/0077923 | A1* | 3/2009 | Mears | E04C 3/09 52/708 |
| 2013/0025425 | A1* | 1/2013 | Knaupp et al. | B26F 3/008 83/177 |
| 2017/0203351 | A1* | 7/2017 | Gonzalez | B21D 7/024 |

* cited by examiner

TOOL FOR CURVING STRUCTURAL FRAMING COMPONENTS

CROSS-REFERENCE TO RELATED APPLICATIONS

This application claims priority to U.S. Provisional Pat. Application Serial No. 62/504,714, filed on May 11, 2017 and entitled "Tool for Curving Structural Framing Components," the content of which being incorporated herein in its entirety.

FIELD OF THE INVENTION

The present invention relates to structural framing members generally, and more particularly to a system and method for conveniently shaping structural framing members to support curved ceiling and wall structures.

BACKGROUND OF THE INVENTION

The production of shaped structural framing members to support curved wall and ceilings has traditionally been a labor-intensive task with substantial opportunity for error. In the past, shaped framing members were constructed by cutting short segments of sheet metal frame members and attaching such segments to a plywood base panel at the top and bottom of a wall or ends of a ceiling section to define the desired curved configuration. The segments would define a desired wall or ceiling curvature, and suitably spaced studs were fixed at their ends to the segments to define the prescribed curvature of the wall or ceiling construction.

To address the challenge of creating curved framing members, the present applicant conceived of and produced an apparatus for shaping metal channels into a prescribed curved configuration while maintaining the structural integrity of the channel members. The apparatus, and methods for producing the shaped framing members with such apparatus, developed by the present applicant is described in U.S. Pat. No. 6,138,359, the content of which being incorporated herein by reference.

Though the general operation of the apparatus described in U.S. Pat. No. 6,138,359 is effective for generating predetermined curvature to structural framing members, operational downtime is incurred when the need arises to adjust the system to accommodate structural framing members of different width dimensions. Through the use of the framing member shaping tool, preparing shaped framing members with precise predetermined curvatures was greatly simplified. Consequently, use of such curved framing members, configured by the shaping tool, has become significantly more popular. Consequently, new applications have been conceived for the use of structural framing members curved on site to meet the specifications of a particular project. In some cases, the construction project may require the use of "U"-shaped channel framing members and "L"-shaped channel framing members, both of various length and width sizes. The existing tool is capable of handling various length framing members of consistent width dimension without modification. However, when a user needs to switch between different width framing members, the tool is preferably modified to best accommodate the different width dimension. Such modification, in the existing tool, requires detachment of the tool from its supporting platform, inverted, and partially disassembled before re-assembly in the modified configuration can occur. This modification process may consume at least several minutes, which translates to costly downtime for the shaping tool.

It is therefore an object of the present invention to provide a structural framing member tool that permits a support fixture modification to accommodate different width dimension framing members without detachment of the tool from a support platform/substructure.

It is a further object of the present invention to provide an adjustable support fixture that accommodates different width structural framing members in a framing member shaping tool, and wherein the adjustment to the support fixture may be accomplished without the need for detaching the shaping tool from a support platform/substructure.

SUMMARY OF THE INVENTION

By means of the present invention, an improved structural framing member shaping tool is provided in which standard operational modifications to a support fixture portion of the tool to accommodate various width-dimension framing members may be accomplished while the tool remains secured to a support platform and/or substructure. By enabling standard operational modification to the framing member support fixture portion of the tool without the need for detachment of the tool from the substructure, a user may quickly adjust the tool to accommodate different width dimension structural framing members.

In one embodiment, a system for shaping a structural framing member, otherwise referred to as a "workpiece" includes a base having an upper side and a generally opposed lower side to separate an upper region coincident with the upper side from a lower region coincident with the lower side. The system includes a first indenting blade for indenting a first portion of the workpiece when the workpiece is positioned in the upper region, and a second indenting blade for indenting a second portion of the workpiece when the workpiece is positioned in the upper region. A blade control apparatus is connected to the base and the first and second indenting blades for moving the first and second indenting blade with respect to the base and into indenting contact with the workpiece. A master base plate having a plurality of first mounting features is secured to the base so that the first mounting features are open to the upper region. A set of a plurality of workpiece support modules are each selectively and removably securable to the master base plate in the upper region at one or more of the first mounting features so as to support the workpiece at least when the first and second indenting blades are moved into indenting contact with the workpiece.

In another embodiment, a system for shaping a workpiece includes a base having a length axis, a width axis, an upper side, and a lower side, with the base being securable to a substructure and orientation in which the lower side is in facing relationship with the substructure. The system includes a first indenting blade for indenting a first portion of the workpiece, and a second indenting blade for indenting a second portion of the workpiece. A blade control apparatus is connected to the base and the first and second indenting blades for moving the first and second indenting blades with respect to the base and into indenting contact with the workpiece. A workpiece guide for supporting the workpiece adjacent to the first and second indenting blades and in an orientation substantially parallel to the length axis of the base is repositionably secured to the base so as to be selectively repositionable along the width axis of the base. The system further includes an attachment mechanism for repositionably securing the workpiece guide to the base, wherein the attachment mechanism includes an elongate slot oriented substantially parallel to the width axis in at least one of the base and the workpiece guide, and a shaft receivable through the elongate slot, and a lock member for fixing a relative position of the shaft in the elongate slot along a direction that is substantially parallel to the width axis by engaging with the shaft. The lock member, when engaged with the shaft, is accessible from above the upper side of the base. A method for shaping a workpiece using the shaping systems described above includes selecting one or more of the workpiece support modules from the set of workpiece support modules, and securing selected ones of the workpiece support modules to the master base plate. The workpiece is then positioned in the upper region at the selected ones of the workpiece support modules, whereafter the blade control apparatus is actuated to move the first and second indenting blades with respect to the base and into indenting contact with the workpiece.

DETAILED DESCRIPTION OF THE PREFERRED EMBODIMENTS

Figure 1:
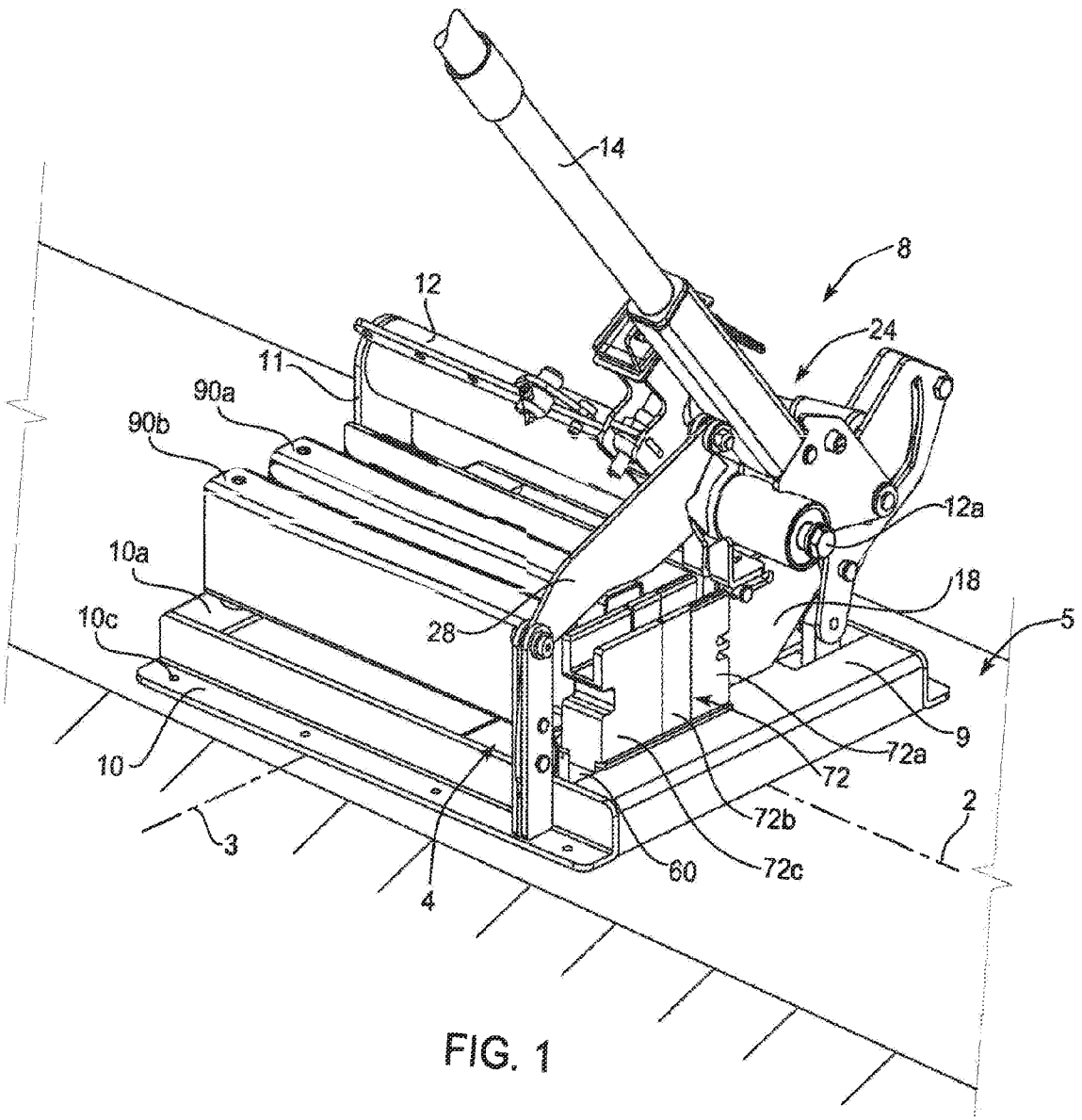
FIG. 1 is a top perspective view of the tool of the present invention mounted on a platform or a substructure.

The objects and advantages enumerated above together with other objects, features, and advances represented by the present invention will now be presented in terms of detailed embodiments described with reference to the attached drawing figures which are intended to be representative of various possible configurations of the invention. Other embodiments and aspects of the invention are recognized as being within the grasp of those having ordinary skill in the art.

Unless otherwise apparent or stated, directional references, such as "upper", "lower", "interior", "exterior", "top", "bottom", "vertical", "horizontal", "upward", "downward", "above", "below", and the like are intended to be relative to the orientation of a particular embodiment of the invention as shown in the figures. In addition, a given reference numeral in the drawings indicates the same or similar structure when it appears in different figures and like reference numerals identify similar structural elements and/or features of the subject invention.

With reference now to the drawing figures, and first to FIG. 1, a system 8 is illustrated for shaping a workpiece 25, such as a wall or ceiling framing member. Workpiece 25 may be a structure of various configuration and/or material. Workpiece 25 may preferably be a wall or ceiling framing member fabricated from a malleable material such as metal. Workpiece 25 may most typically be elongated bodies with a substantially C-shaped or L-shaped cross-section, though it is contemplated that workpiece 25 may be any of a variety of cross-sectional configurations. A common material for workpiece 25 is steel, in the form of sheet metal with a thickness typically ranging between 8-24 gage. Workpiece 25 finds common use in the construction of steel-framed walls and ceilings in building construction applications.

System 8 includes a base 10 having an upper side 10*a* and a generally opposed lower side 10*b* to separate an upper region 4 coincident with upper side 10*a* from a lower region 6 coincident with lower side 10*b*. Base 10 of system 8 is preferably securable to a support platform or substructure 5 at lower region 6. In some embodiments, fasteners may be used to secure base 10 to substructure 5 through fastening apertures 10*c* in base 10.

Upper side 10*a* of base 10 may provide a platform upon which an operating mechanism of system 8 is supported. Support brackets 11 may be fixed to base 10, and a shaft 12 may be journaled for rotation to brackets 11, as by suitable support pins 12*a*. An operating handle 14 is connected to shaft 12 to provide rotation of shaft 12 about an axis provided by support pins 12*a*.

A first indenting blade 18 is provided for indenting a first portion 25*a* of workpiece 25 when workpiece 25 is positioned in upper region 4, as illustrated in FIG. 3. First indenting blade 18 is mounted for sliding movement with respect to base 10, as set forth in U.S. Pat. No. 6,138,359, which assigned to the present applicant, and is incorporated herein by reference. A second indenting blade 28 is provided in system 8 for indenting a second portion - 25*d*--of workpiece 25 when workpiece 25 is positioned in upper region 4, as illustrated in FIG. 3. Second indenting blade 28 is mounted via an upstanding support post member 30 secured at a front end of the base 10. The upstanding support post member 30 is adjacent the work piece support module 72 and positions the second indenting blade 28 above the work piece support module 72. The second indenting blade 28 pivotally moves, and is actuatable to move the second indenting blade 28 into indenting contact with second portion 25*d* of workpiece 25.

A blade control apparatus 24 is connected to base 10 and first and second indenting blades 18, 28 for moving first and second indenting blades 18, 28 with respect to base 10, and into indenting contact with workpiece 25. Blade control apparatus 24 may comprise a means for operating first and second indenting blades 18, 28, as described in U.S. Pat. No. 6,138,359. Generally, handle 14 may be pivotally actuated to rotate shaft 12 about an axis defined by pin 12*a*. Such rotational movement of shaft 12 effectuates the movement of first and second indenting blades 18, 28 with respect to base 10, and into indenting contact with workpiece 25.

Figure 4:
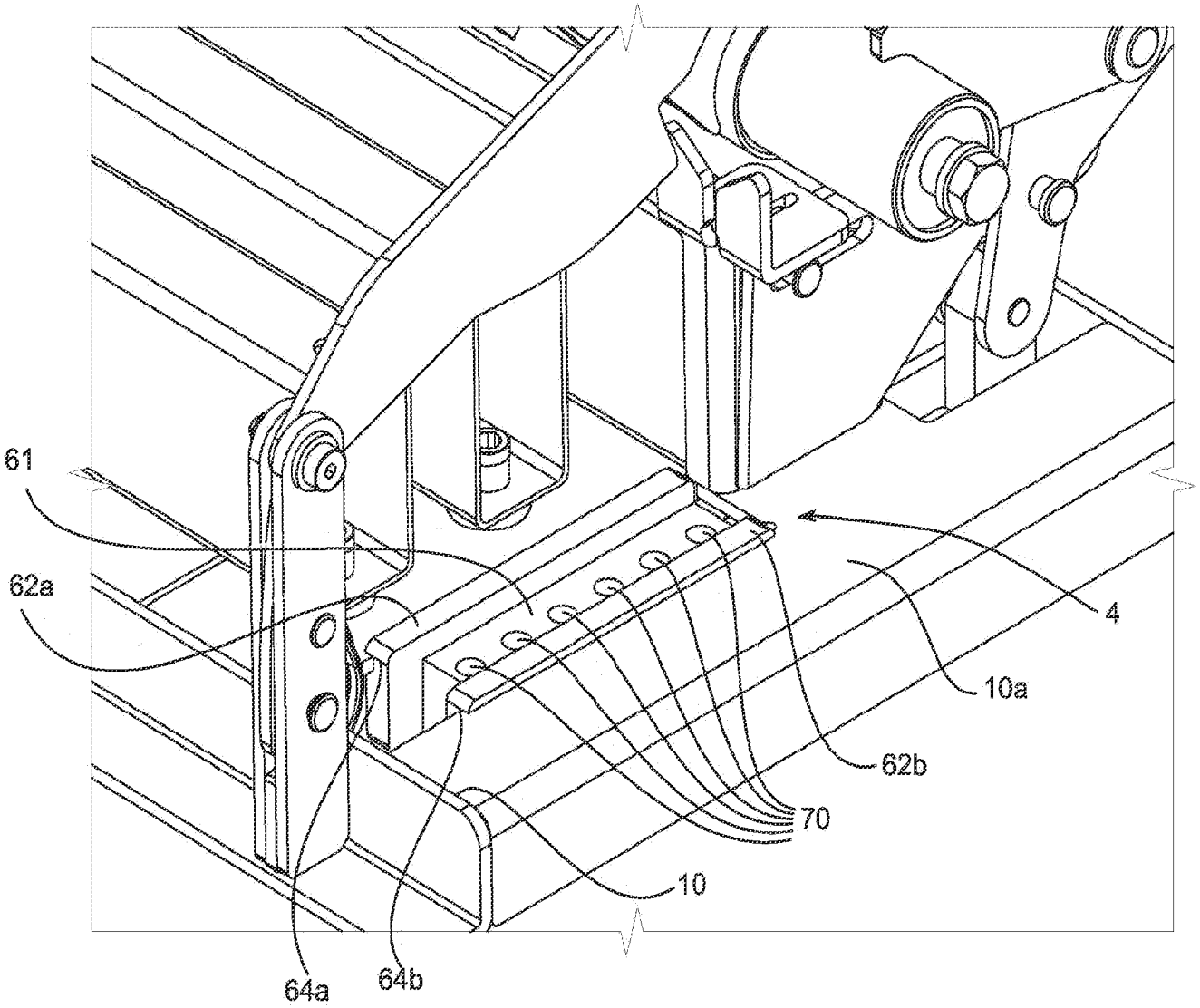
FIG. 4 is an enlarged top perspective view of a portion of the tool of the present invention.
Figure 5:
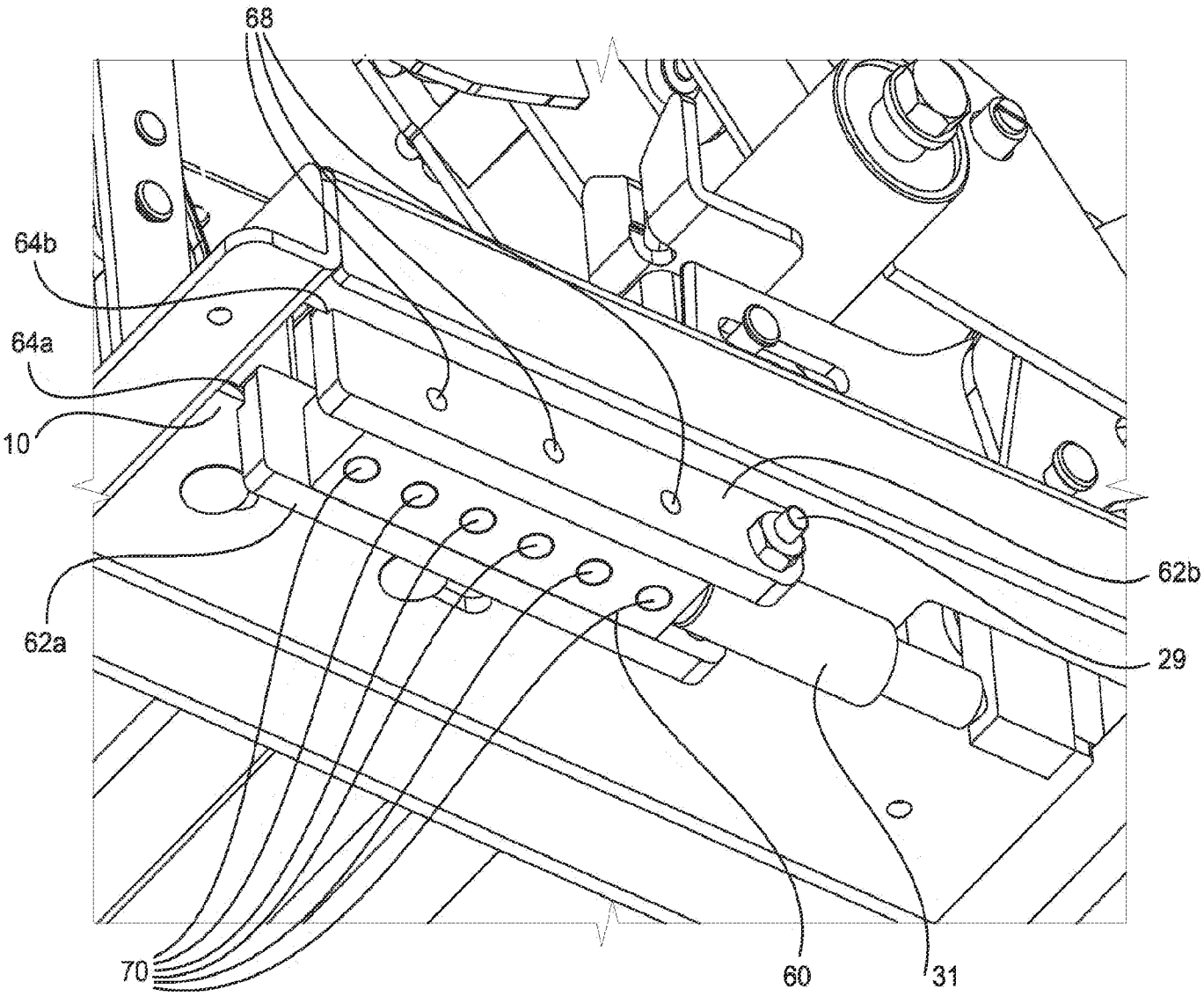
FIG. 5 is an enlarged bottom perspective view of a portion of the tool of the present invention.
Figure 6:
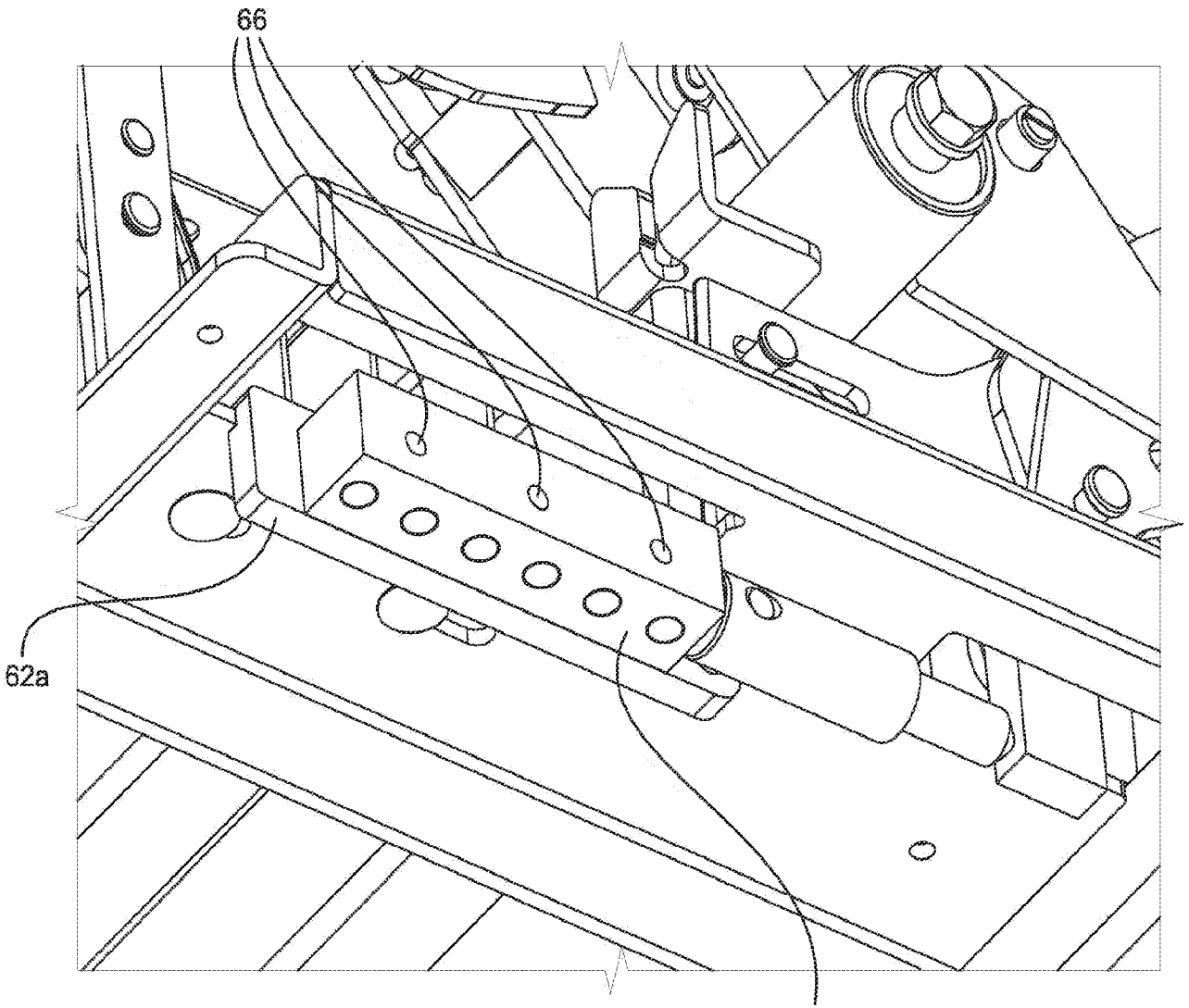
FIG. 6 is an enlarged bottom perspective view of a portion of the tool of the present invention.

A master base plate 60 is directly or indirectly secured to base 10, and may be secured to the platform of upper side 10*a*. As shown in FIGS. 4 and 5, master base plate 60 may be indirectly secured to base 10 through side bars 62*a*, 62*b*. In the illustrated embodiment, side bars 62*a*, 62*b* may be slidably engaged to base 10, and particularly platform 9 of base 10. In the illustrated embodiment, side bars 62*a*, 62*b* may be slidably engaged with base 10 by platform 9 being received in respective engagement grooves 64*a*, 64*b* of side bars 62*a*, 62*b*. In other embodiments, side bars 62*a*, 62*b* may be fixedly or otherwise secured to base 10 to serve as a mounting feature for master base plate 60. Side bars 62*a*, 62*b* may be connected to link 31 with a bolt 29 or other fastening mechanism. Master base plate 60 may be secured to side bars 62*a*, 62*b* through any of a variety of means, including one or more fasteners extending through respective securement apertures 66 in master base plate 60 and apertures 68 in side bars 62*a*, 62*b*. In another embodiment, master base plate 60 may be configured to be directly engaged with base 10, without side bars 62*a*, 62*b*.

Master base plate 60 includes a plurality of first mounting feature 70 that are arranged so that when master base plate 60 is secured to base 10, first mounting feature 70 are open to upper region 4. In the illustrated embodiment, first mounting feature 70 may be apertures extending through master base plate 60. It is contemplated, however, that first mounting features 70 may include receptacles, apertures, protrusions, and other features that permit engagement with one or more other structures. First mounting feature 70 may be arrayed about a first surface 61 of master base plate 60 open to upper region 4. The array of first mounting feature 70 may be appropriate for receiving one or more workpiece support modules in a variety of arrangements. In the illustrated embodiment, first mounting feature 70 may be spaced apart along a substantially linear arrangement at first surface 61 of master base plate 60. The spacing of first mounting feature 70 may be appropriate to provide a customized pattern of securement of workpiece support modules to the master base plate 60.

A set 72 of a plurality of workpiece support modules are provided to support workpiece 25 during and between indenting operations performed by system 8 on workpiece 25. In the illustrated embodiment, module set 72 includes at least three workpiece support modules 72*a*, 72*b*, 72*c*, wherein each of modules 72*a* – 72*c* are selectively and removably securable to master base plate 60 at one or more of first mounting features 70 to support workpiece 25 at least when first and second indenting blades 18, 28 are moved into indenting contact with workpiece 25. As shown in FIG. 1, workpiece support modules 72*a* – 72*c* may be securable to master base plate 60 in immediate adjacency to one another, or may instead be securable to master base plate 60 in spaced relationship with one another.

Each of workpiece support modules 72*a* – 72*c* have a module width $W_1$, $W_2$, $W_3$, such that securement of one or more of workpiece support modules 72*a* – 72*c* to master base plate 60 creates a total width $W_t$ that may correspond to an effective workpiece width 26 of workpiece 25. Total width $W_t$ may be less than, substantially equal to, or greater than the effective workpiece width 26 of workpiece 25. The total width $W_t$ created through the selective use of one or more workpiece support modules 72 is therefore intended to be suitable to effectively support workpiece 25 at least during the workpiece shaping procedure. Each of workpiece support modules 72*a* – 72*c* may be individually secured to master base plate 60 to define an appropriate total width $W_t$ that is useful for supporting workpiece 25. Thus, various combinations of workpiece support modules 72*a* – 72*c*, including any number of workpiece support modules that may be necessary to achieve the desired supporting arrangement. It is contemplated that workpiece support module set 72 may include any number of individual modules, and that such modules may be of various size and shape to accommodate various workpiece sizes and shapes. The illustrated embodiment of set 72 shows an example set of three modules 72*a*-72*c*, but it is contemplated that other shapes of modules 72 may be employed in the present invention.

Workpiece support modules 72*a* – 72*c* include second mounting features 74 that may include at least one of receptacles, apertures, and protrusions that coordinate with first mounting features 70 of master base plate 60 to facilitate securement of workpiece support modules 72*a* – 72*c* to master base plate 60. In some embodiments, second mounting features 74 may be axially alignable with receptacles of first mounting features 70. An example arrangement for securing workpiece support modules 72*a* – 72*c* to master base plate 60 is illustrated in isolation in FIG. 9. Fasteners may be utilized for securing workpiece support modules 72*a* – 72*c* to master base plate 60 by extending through the apertures of second mounting feature 74, and into the respective receptacles of first mounting feature 70.

Figure 10A:
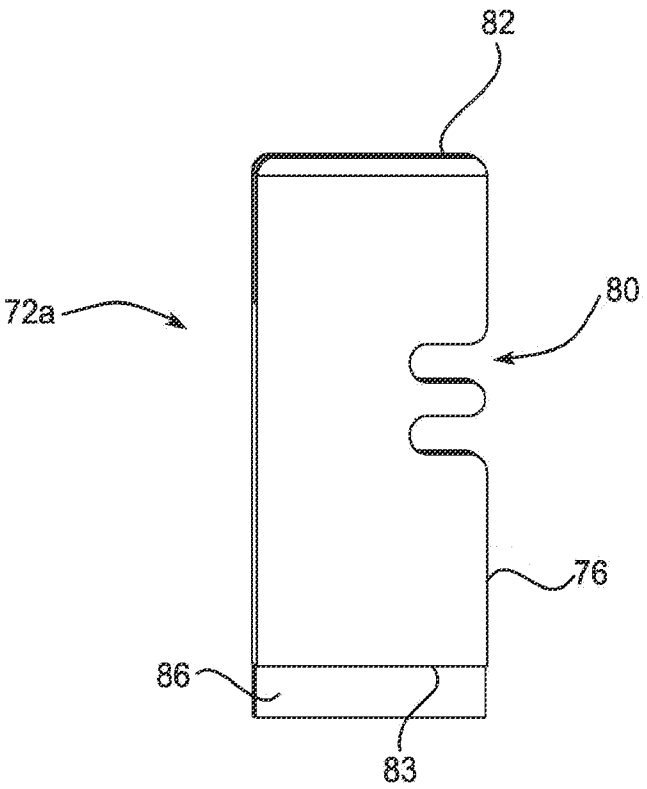
FIG. 10A is a side elevational view of a portion of the tool of the present invention.
Figure 10C:
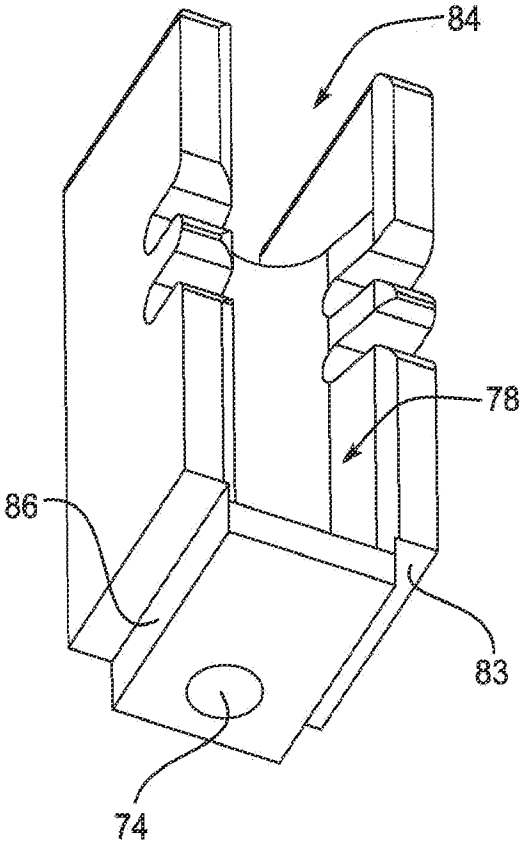
FIG. 10C is a bottom perspective view of the portion of the tool of the present invention illustrated in FIGS. 10A and 10B.
Figure 10B:
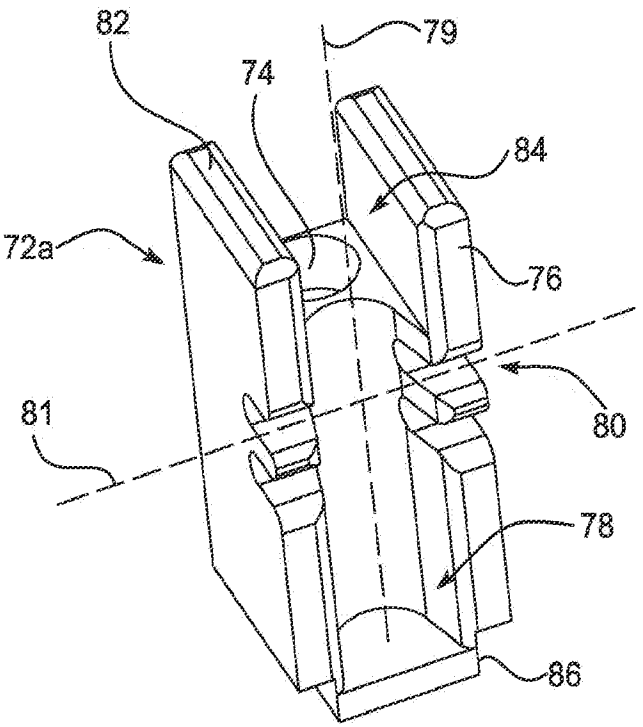
FIG. 10B is a top perspective view of the portion of the tool of the present invention illustrated in FIG. 10A.

A first one 72*a* of workpiece support module 72 may be removably securable to master base plate 60 at a position adjacent to first indenting blade 18, as is illustrated in FIG. 1. First workpiece support module 72*a* is illustrated in isolation in FIGS. 10A-10C. A first side 76 of first workpiece support module 72*a* facing first indenting blade 18 in the orientation illustrated in FIG. 1 includes a first slot 78 that is sized and configured for receiving at least one of a first indented portion 25*b* of workpiece 25 and first indenting blade 18. When first indenting blade 18 is moved by blade control apparatus 24 into indenting contact with first portion 25*a* of workpiece 25, first indenting blade 28 may push first portion 25*a* of workpiece 25 into slot 78 of first workpiece support module 72*a*. Movement of first indenting blade 18 may continue to an extent at which at least a portion of first indenting blade 18 may extend into slot 78, wherein both of first portion 25*a* of workpiece 25 and indenting blade 18 may be received in slot 78 at first side 76. Preferably, slot 78 may be configured to accommodate the indenting operation to first portion 25*a* of workpiece 25 via first indenting blade 18. To do so, first workpiece support module 72*a* may operably support first portion 25*a* of workpiece 25 at first side 76. Pressure applied by first indenting blade 18 forces first portion 25*a* of workpiece 25 against first side 76 of first workpiece support module 72*a* until the material of first portion 25*a* deforms into slot 78 as a crimp, thereby shortening one side of workpiece 25 by a predetermined amount to correspondingly create a predetermined curvature of workpiece 25. In some embodiments, first side 76 of first workpiece support module 72*a* includes a second slot 80 that may preferably be sized and configured to receive a flange portion of workpiece 25. Second slot 80 may be oriented along a second slot axis 81 that is substantially perpendicular to first slot axis 79. First side 76 may include a plurality of second slots 80 oriented in parallel to second slot axis 81 to receive a flange of workpiece 25 that is oriented perpendicularly to first portion 25*a*.

Figure 8:
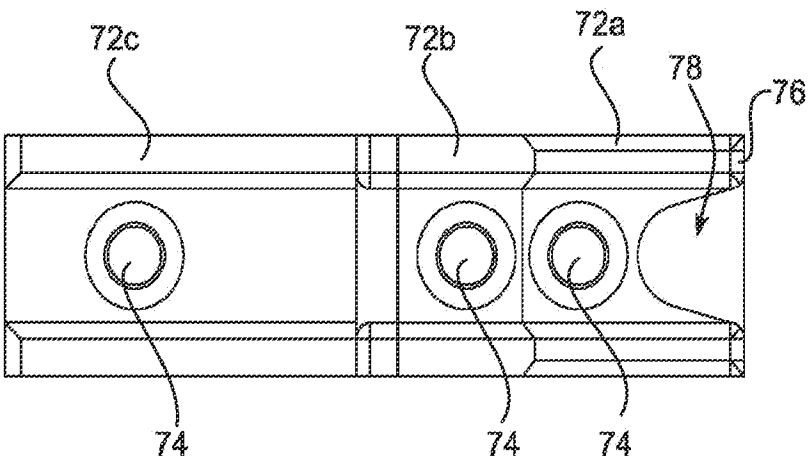
FIG. 8 is a top plan view of the portion of the tool of the present invention illustrated in FIG. 7.
Figure 7:
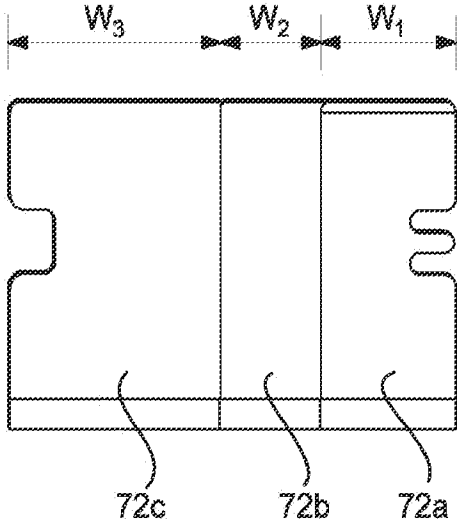
FIG. 7 is a side elevational view of a portion of the tool of the present invention.
Figure 9:
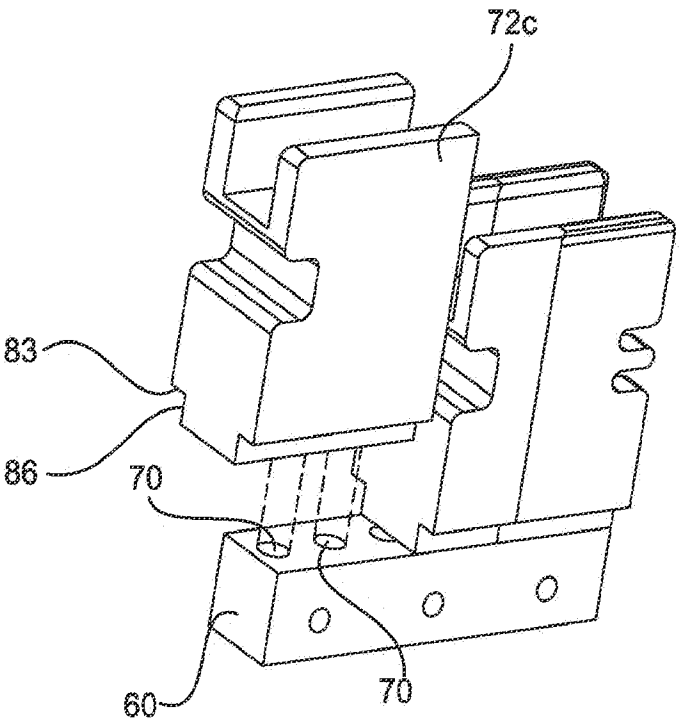
FIG. 9 is a perspective view of the portion of the tool of the present invention illustrated in FIGS. 7 and 8.

A second side 82 of first workpiece support module 72*a* faces generally oppositely from master base plate 60 when first workpiece support module 72*a* is secured to master base plate 60. Second side 82 of first workpiece support module 72*a* includes a third slot 84 that is preferably sized and configured for receiving at least one of a second indented portion 25*c* of workpiece 25 and second indenting blade 28. Similarly to that described above with respect to creating crimp 25*b* in first portion 25*a* of workpiece 25 at first slot 78, an adjacent crimp formed at indent 25*c* may be created by second indenting blade 28 being moved by blade control apparatus 24 to apply pressure against second portion 25*d* of workpiece 25 to an extent at which the material of second portion 25*d* deforms into third slot 84 at second side 84 of first workpiece support module 72*a*. In this matter, at least a portion of second indenting blade 28 may be received in third slot 84 as second indenting blade 28 forms an indent into second portion 25*d* of workpiece 25. As shown in FIGS. 8 and 9, each of workpiece support modules 72*a* – 72*c* include a slot that may be axially alignable with third slot 84 of first workpiece support module 72*a*, such that second indenting blade 28 may indent second portion 25*d* into a continuous slot formed by one or more workpiece support modules 72 supporting workpiece 25 while secured to master base plate 60.

Figure 11:
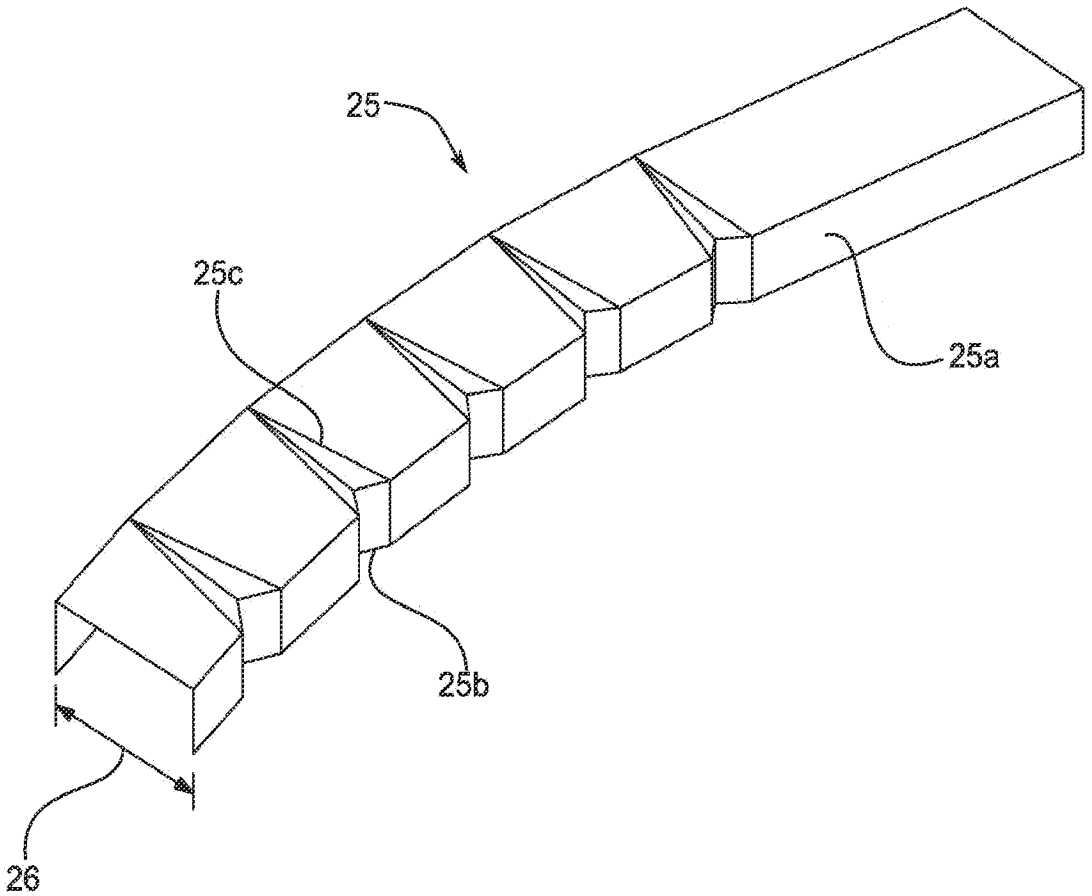
FIG. 11 is a top perspective view of a workpiece following the shaping procedure performed by the tool of the present invention.
Figure 12:
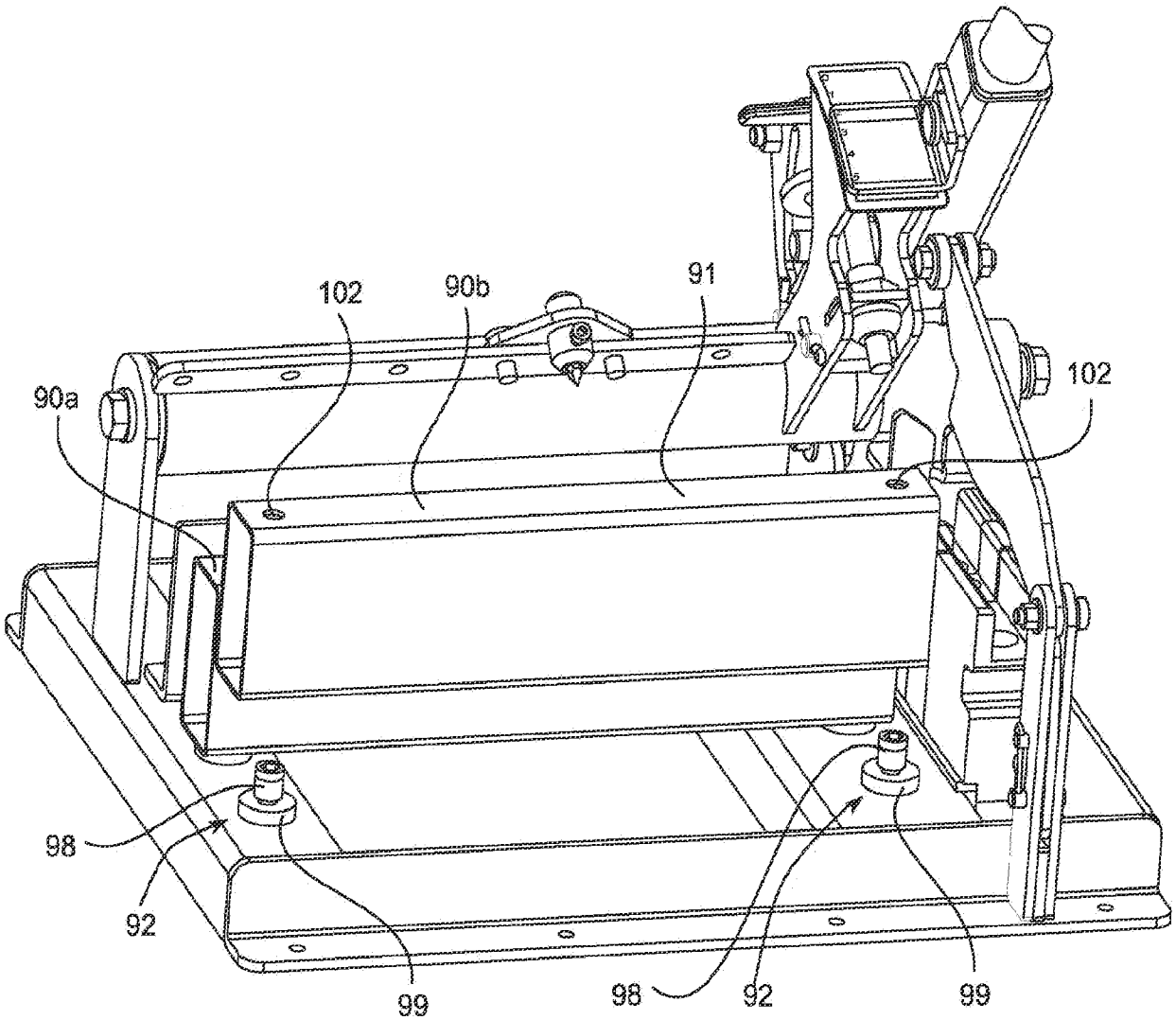
FIG. 12 is a top perspective view of the tool of the present invention.
Figure 13:
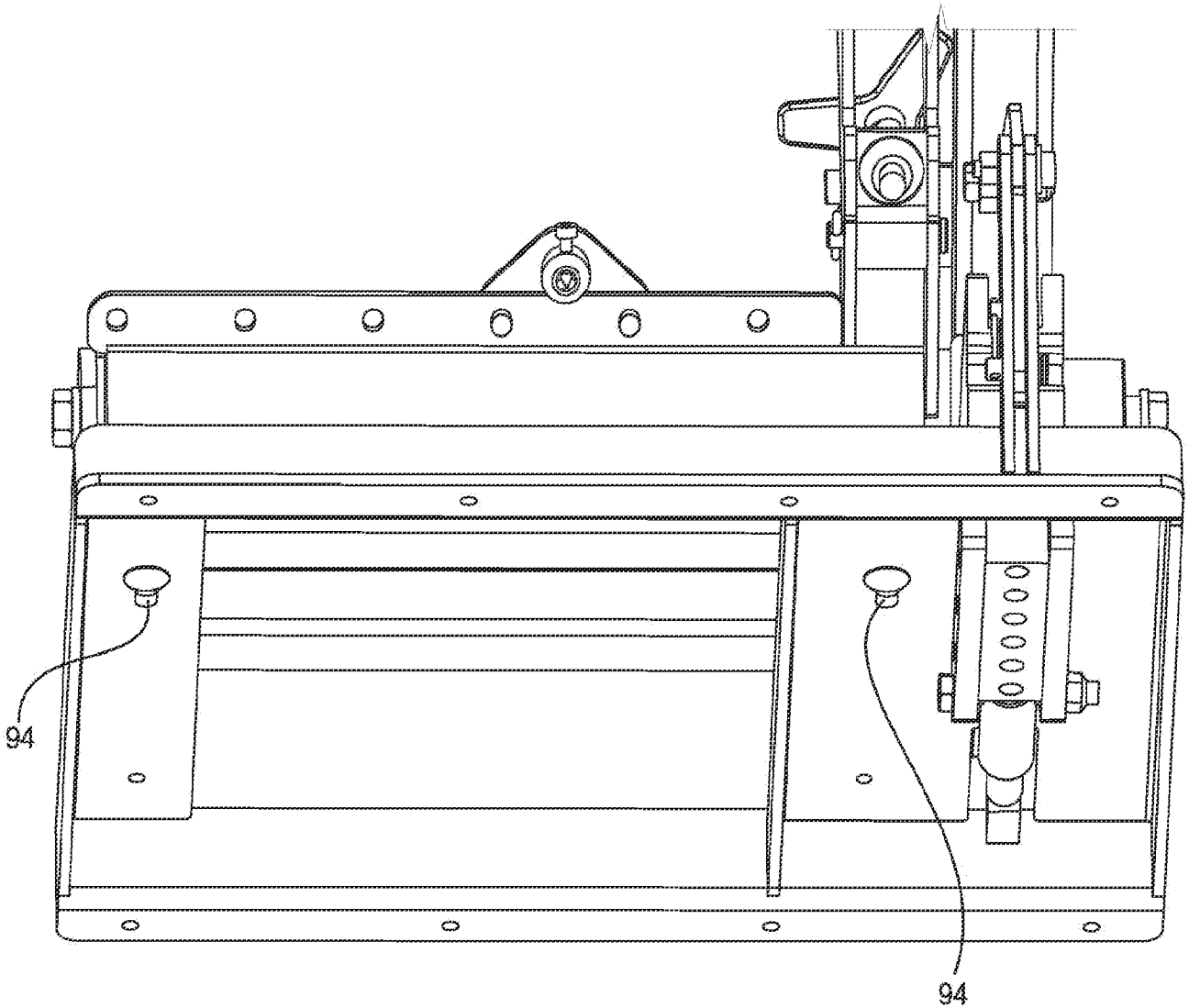
FIG. 13 is a bottom perspective view of the tool of the present invention.
Figure 14:
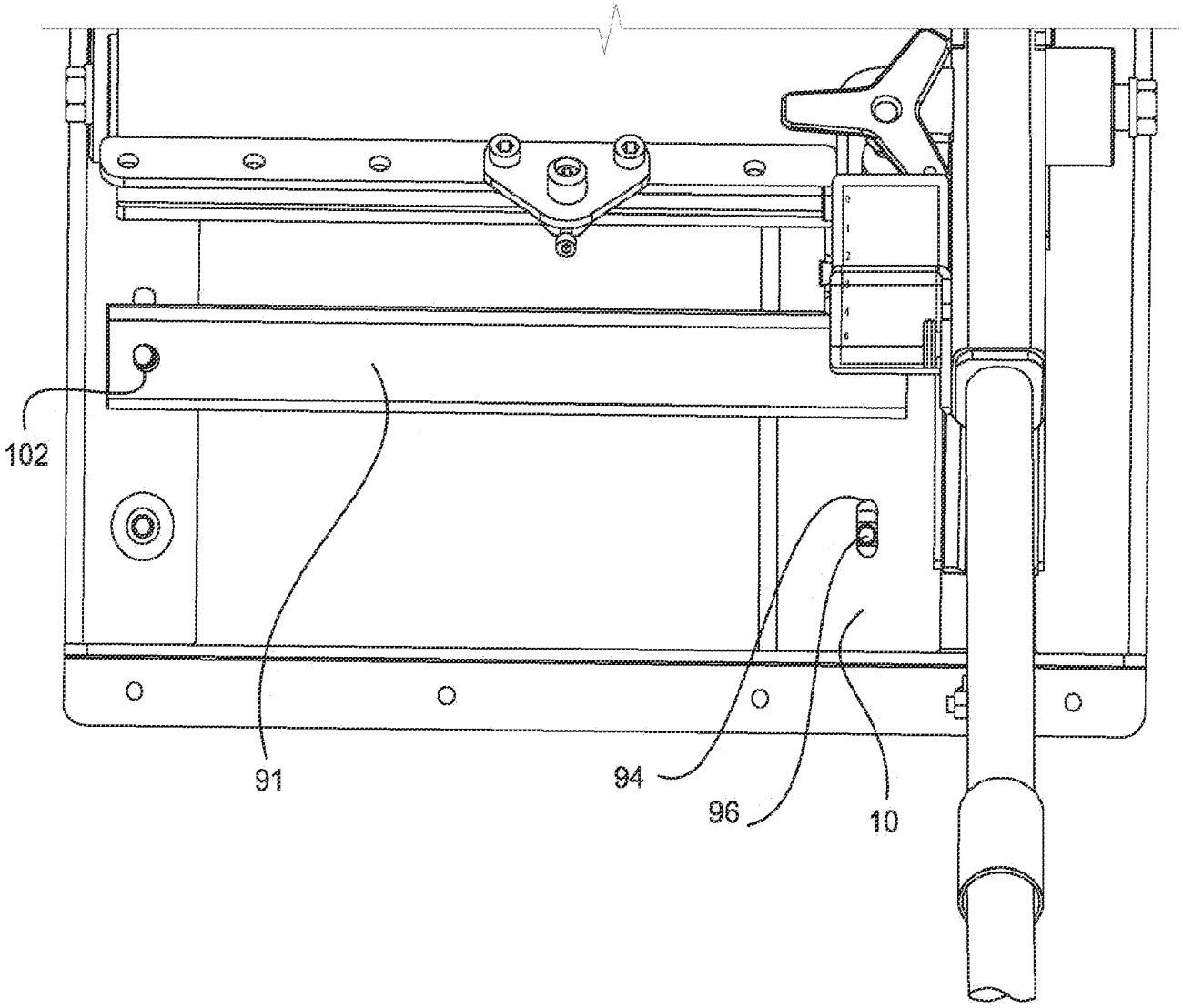
FIG. 14 is a top plan view of the tool of the present invention.
Figure 15:
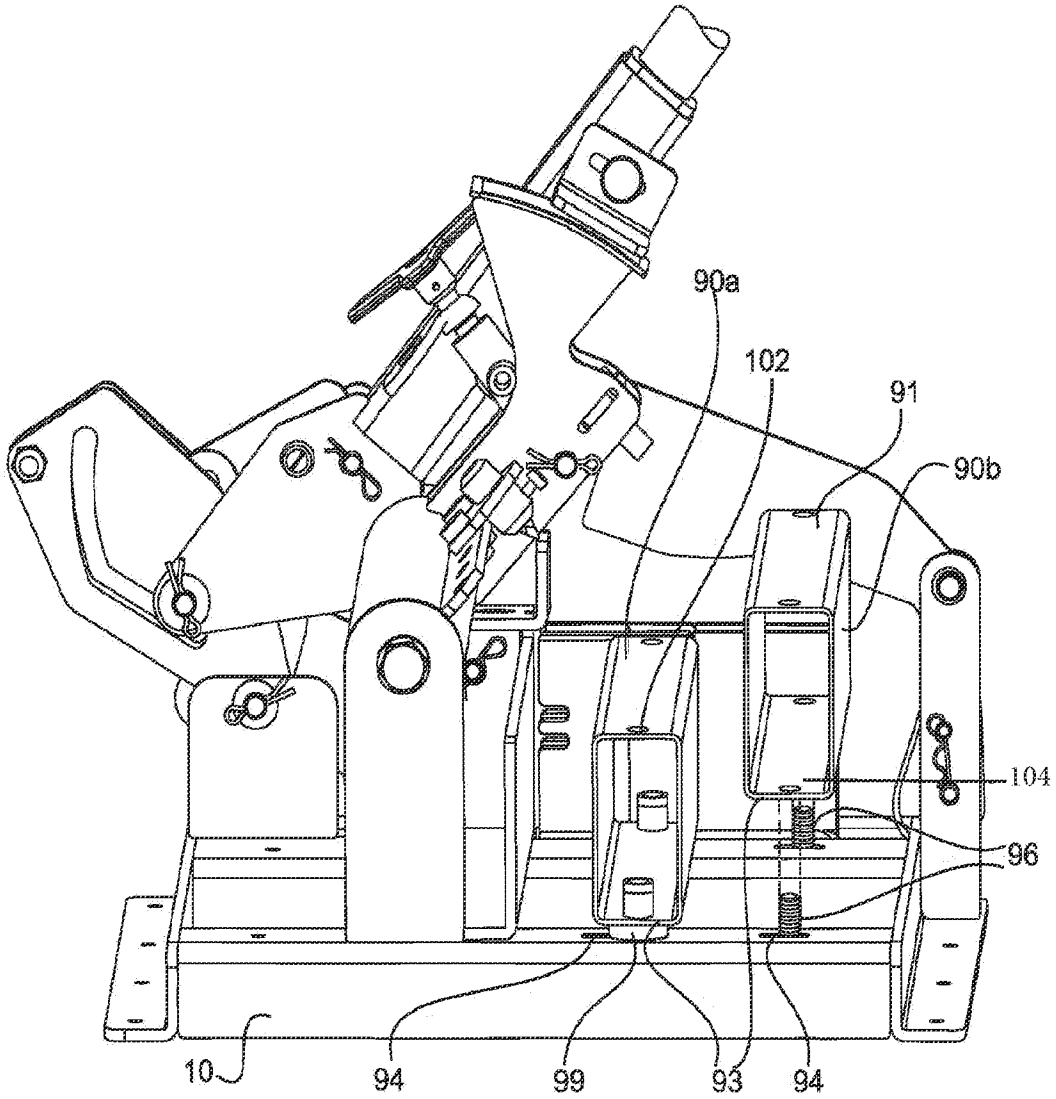
FIG. 15 is a perspective view of the tool of the present invention.

The relative arrangement of first and third slots 78, 84 permit the formation of adjacent indentations 25*b*, 25*c* in workpiece 25, as illustrated in FIG. 11. The adjacency of indentations 25*b*, 25*c* aids in the consistency of curve generation using system 8 by avoiding buckling or other malformations in workpiece 25 as a result of the crimping process. An adjustment mechanism, such as described in U.S. Pat. No. 6,138,359 or otherwise, controls the depth of indentations 25*b* and 25*c* formed in workpiece 25. The depth of indentations 25*b*, 25*c*, as well as the linear spacing of indentations along workpiece 25, control the curvature imparted to workpiece 25. The embodiment of workpiece 25 illustrated in FIG. 11 includes a workpiece width 26 that is defined between opposed flanges of workpiece 25, which flanges are connected together by a web. In the nomenclature utilized herein, the one or more "flanges" may be the first portion 25*a*, while the "web" may be second portion 25*d*. Other embodiments of workpiece 25 may include only one flange, or may include one or more compound flanges having a primary portion extending from the web, and a secondary portion extending angularly from the primary portion.

Workpiece support modules 72 may include an insert portion 86 that is arranged to be received between sidebars 62*a*, 62*b* when secured to master base plate 60. Insert portion 86 therefore provides a locating feature to properly position workpiece support module 72 at master base plate 60. Insert portion 86 further enhances stability of workpiece support module 72, helping to prevent unwanted motion of workpiece support module 72 during operation of system 8. Insert portion 86 depends downwardly from a third side 83 of workpiece support module 72, which third side 83 is in generally facing relationship with master base plate 60 when workpiece support module 72 are secured to master base plate 60. Insert portion 86 may have a substantially rectangular or other polygonal cross-sectional configuration to present flat edges for engagement with one or more of base 10, master base plate 60, and side bars 62*a*, 62*b*.

An aspect of the present invention is in the convenient installation and replacement of workpiece support module 72 in a position to support workpiece 25 in upper region 4. Because first mounting feature 70 of master base plate 60 are open to access from upper region 4, workpiece support modules 72 may be selectively secured to, and removed from, master base plate 60. In one example, a fastener may extend through aperture 74 in third slot 84, and through workpiece support module 72 into a receptacle of first mounting features 70. Installation and removal of workpiece support module 70 may accordingly be quickly and easily accomplished from upper region 4, and thus without the need to detach base 10 from substructure 5, as in the prior art tool. The user of system 8 may therefore quickly change from applying curvature to a workpiece 25 with a first width 26 to a different sized or shaped workpiece 25 with a different width 26 by quickly arranging an appropriate one or more workpiece support module 72 at master base plate 60. In this manner, one may replace at least one of workpiece support module 72 with another of workpiece support module 72 of the set of workpiece support module 72 by accessing one or more first mounting features 70 from upper region 4.

System 8 preferably further includes one or more workpiece guides 90*a*, 90*b* that may be preferably arranged to support workpiece 25 adjacent to first and second indenting blades 18, 28, and in an orientation substantially parallel to a length axis 2 of base 10. Workpiece guide 90 may be repositionably secured to base 10 so as to be selectively repositionable along a width axis 3 of base 10. In the illustrated embodiment, a plurality of workpiece guides 90*a*, 90*b* are provided for supporting workpiece 25 adjacent to first and second indenting blades 18, 28, and in an orientation substantially parallel to length axis 2 of base 10. The plurality of workpiece guides 90*a*, 90*b* may be provided to best accommodate workpieces 25 of various workpiece widths 26. One or more of the workpiece guides 90*a*, 90*b* may be selectively repositionable along width axis 3 to thereby accommodate workpieces 25 of different workpiece widths 26.

Figure 2:
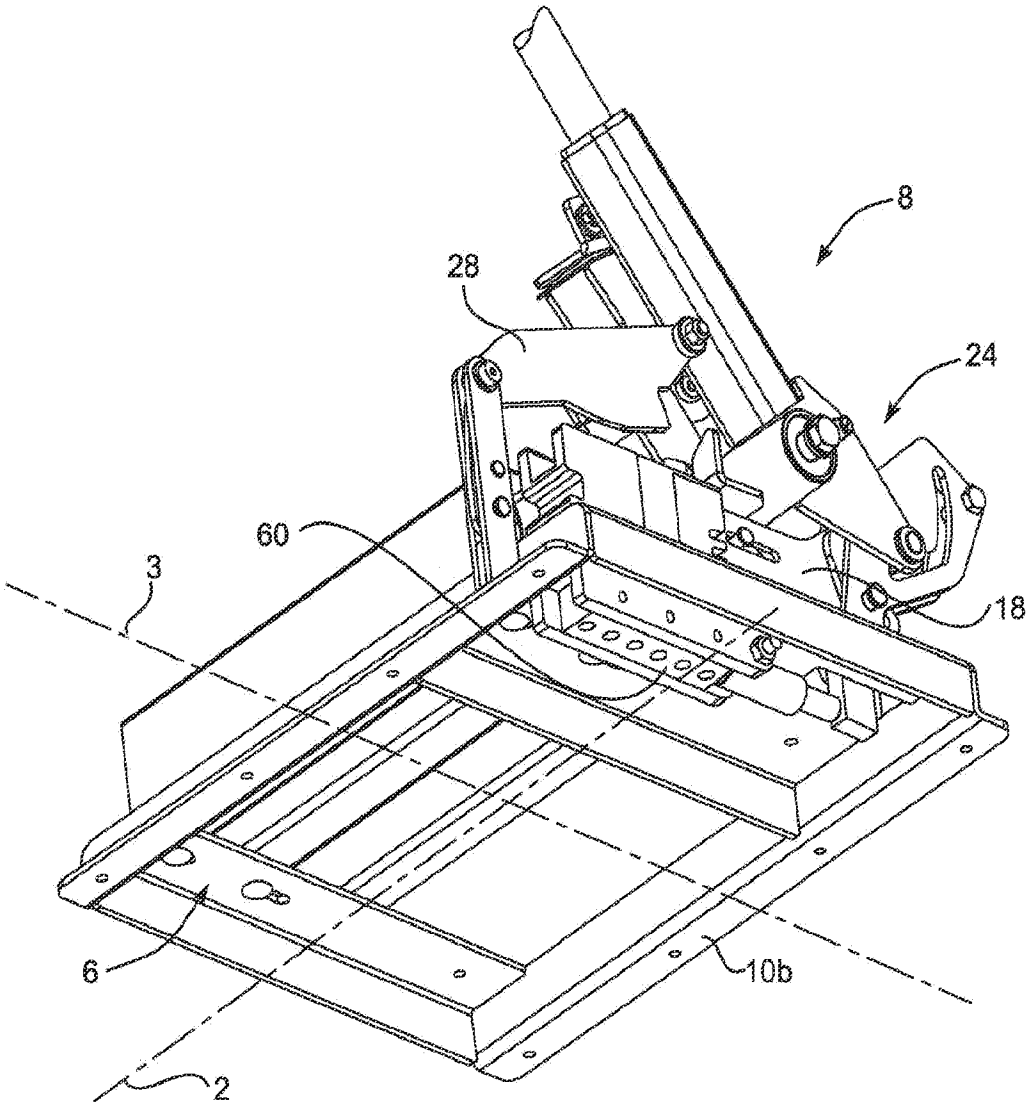
FIG. 2 is a bottom perspective view of the tool of the present invention.
Figure 3A:
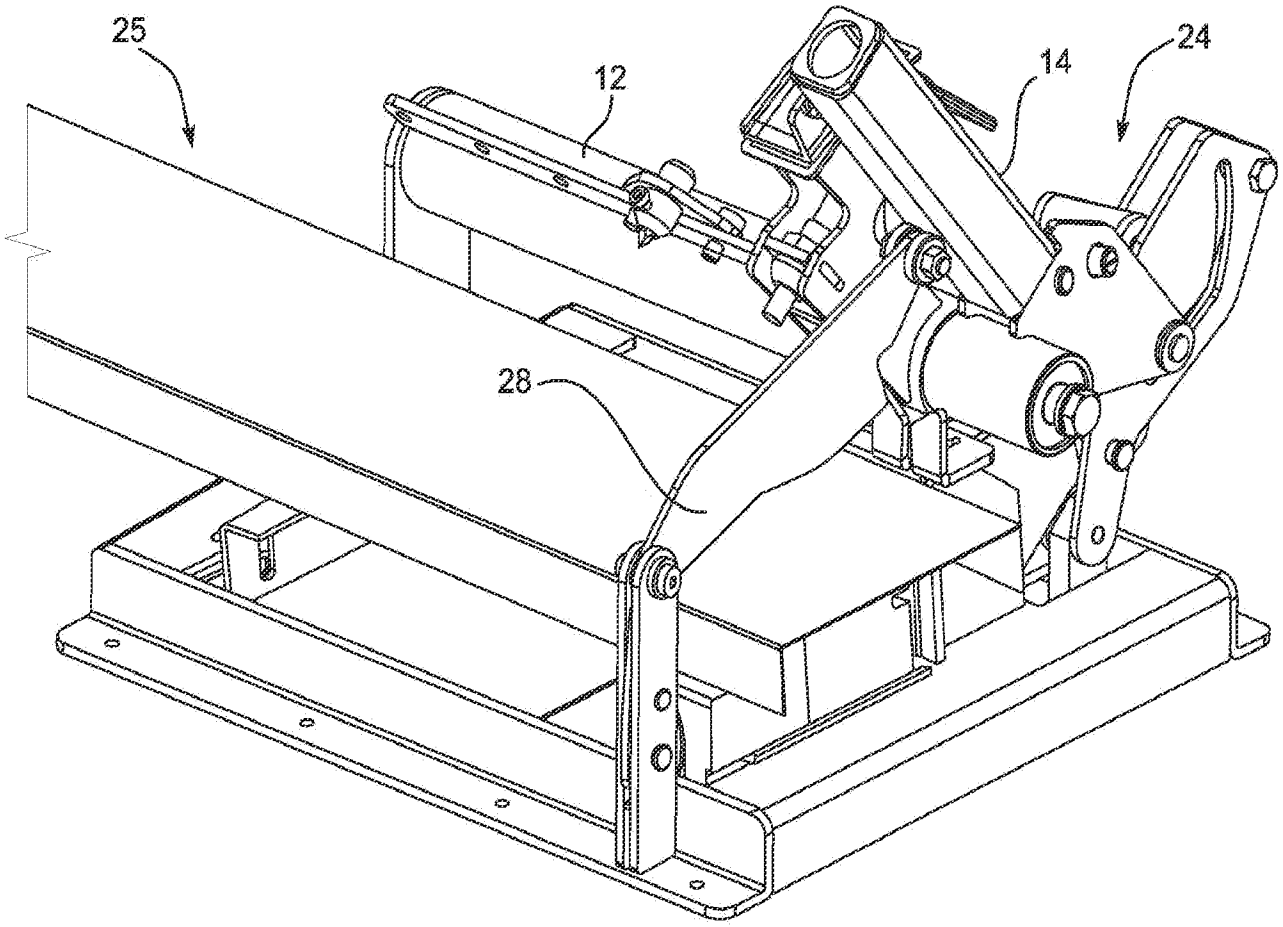
FIG. 3A is a top perspective view of the tool of the present invention with the workpiece positioned to receive a shaping operation by the tool.
Figure 3B:
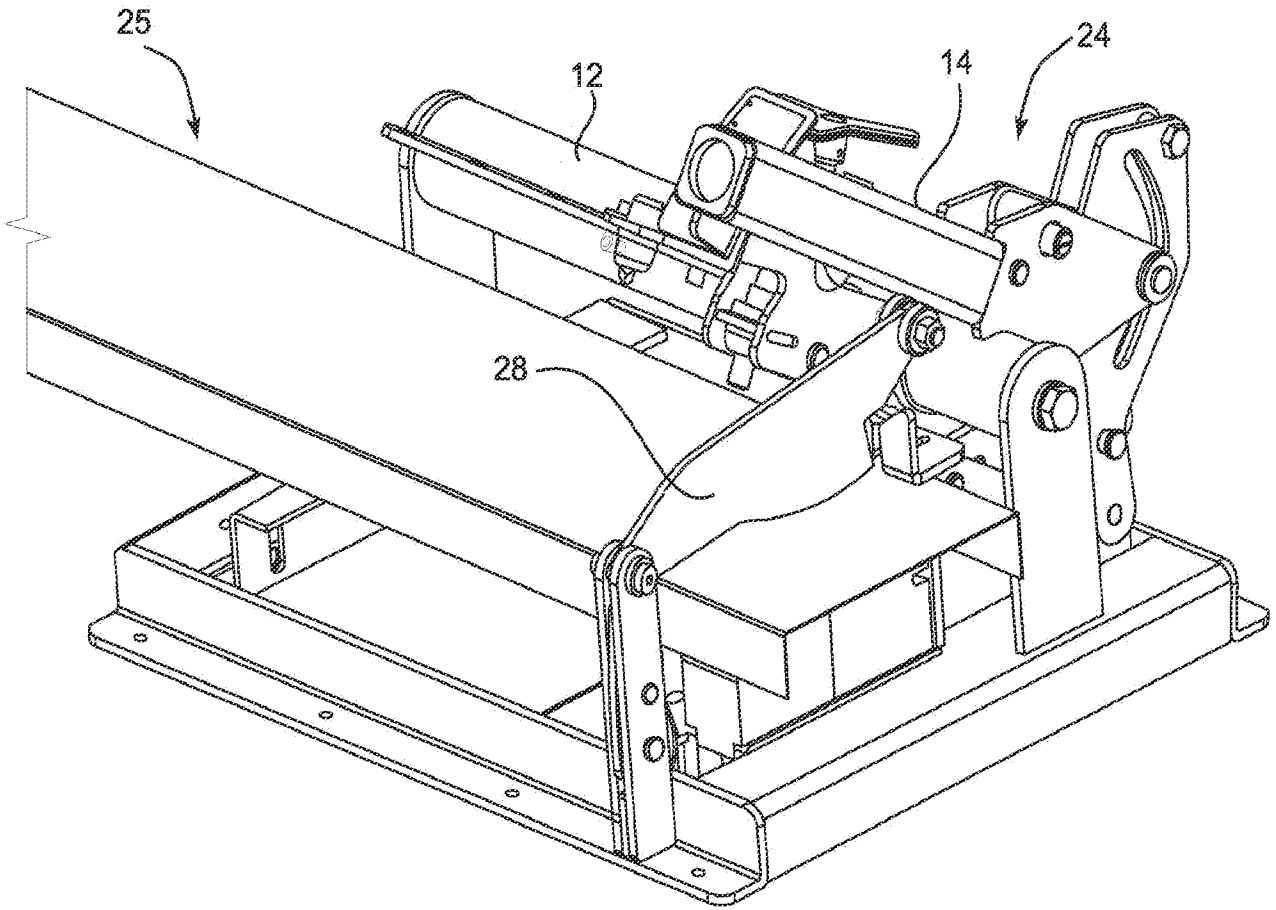
FIG. 3B is a top perspective view of the tool of the present invention preparing to perform a shaping operation to the workpiece.
Figure 3C:
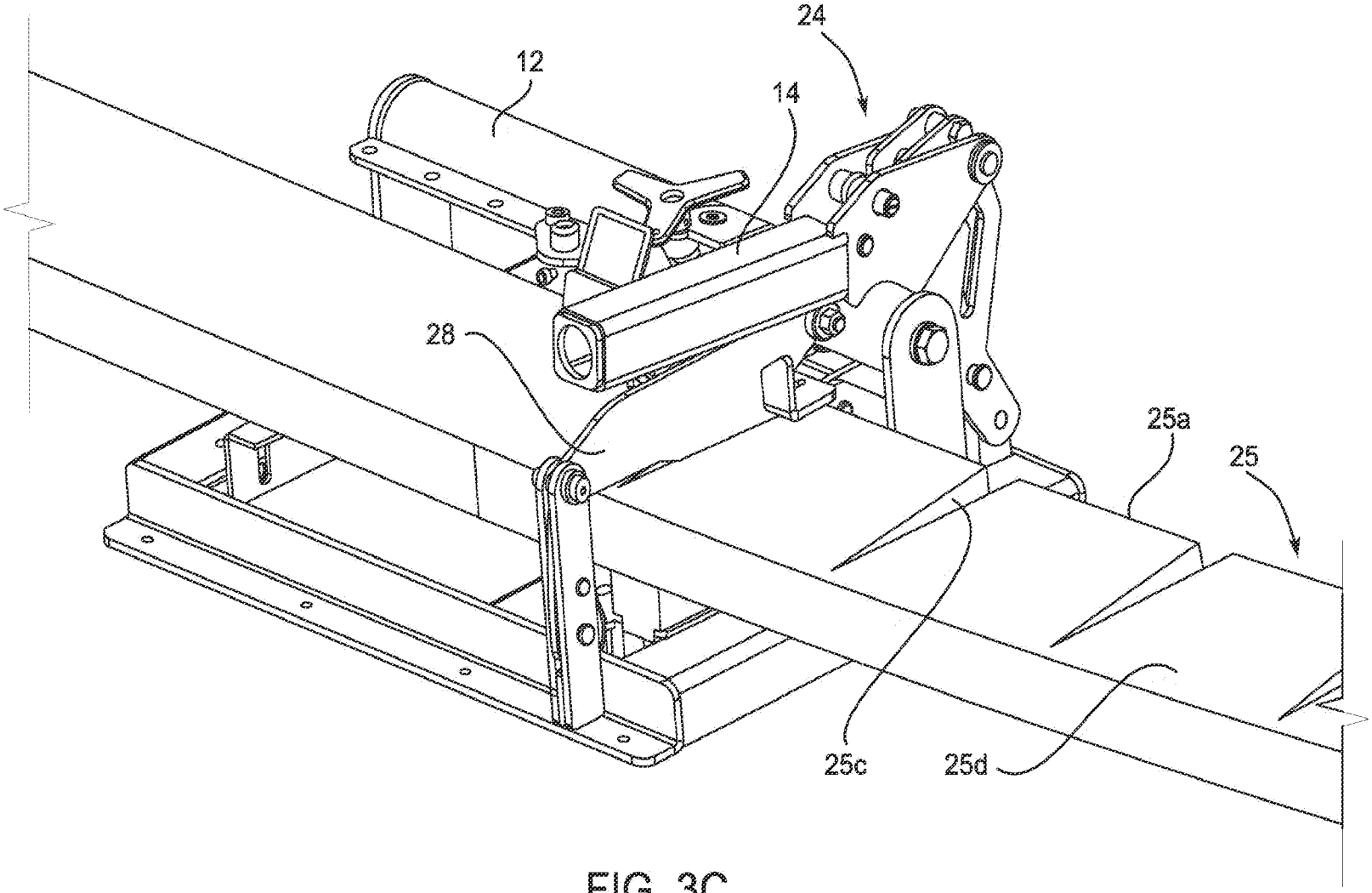
FIG. 3C is a top perspective view of the tool of the present invention performing a shaping operation to the workpiece after performing previous shaping operations to the workpiece.
Figure 3D:
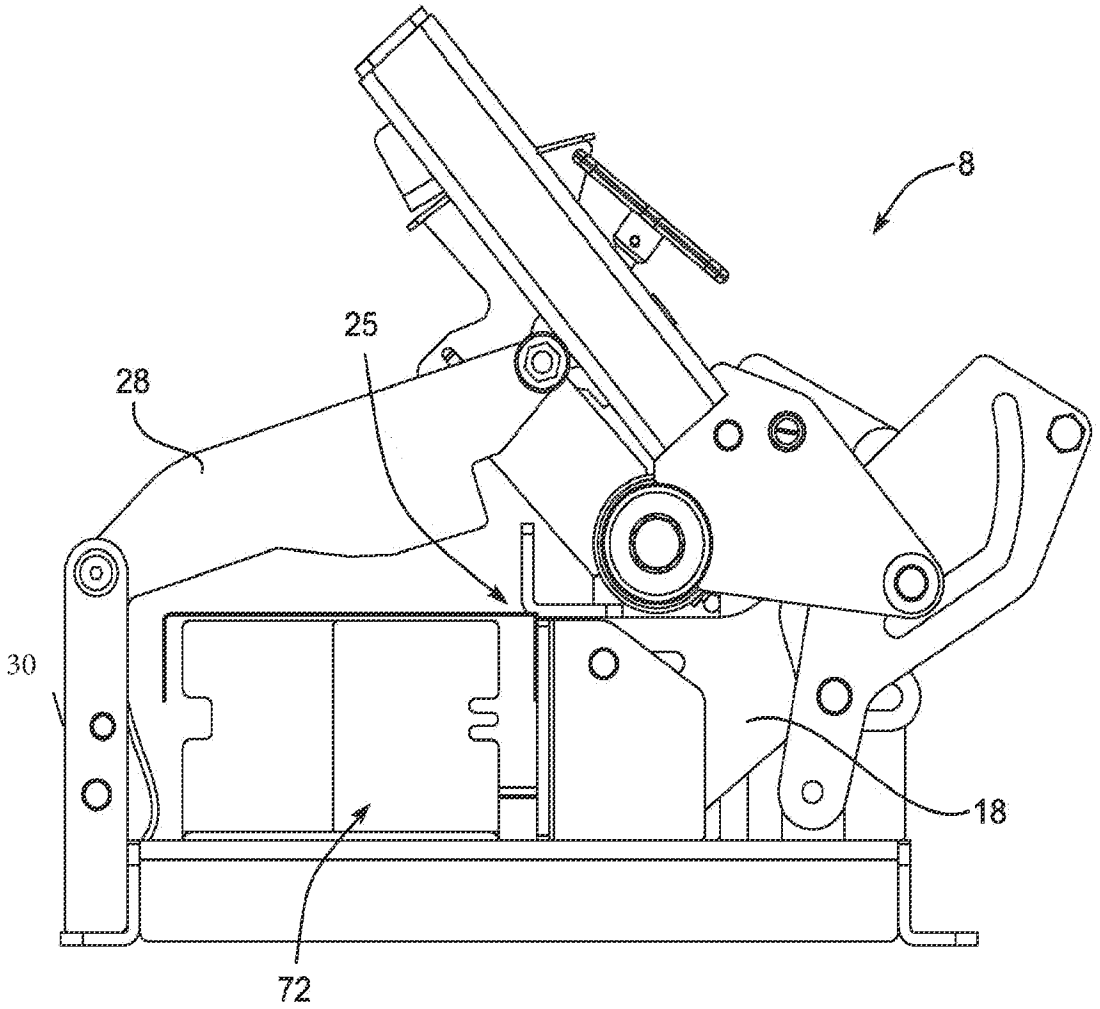
FIG. 3D is an end elevational view of the tool of the present invention supporting a workpiece.
Figure 3E:
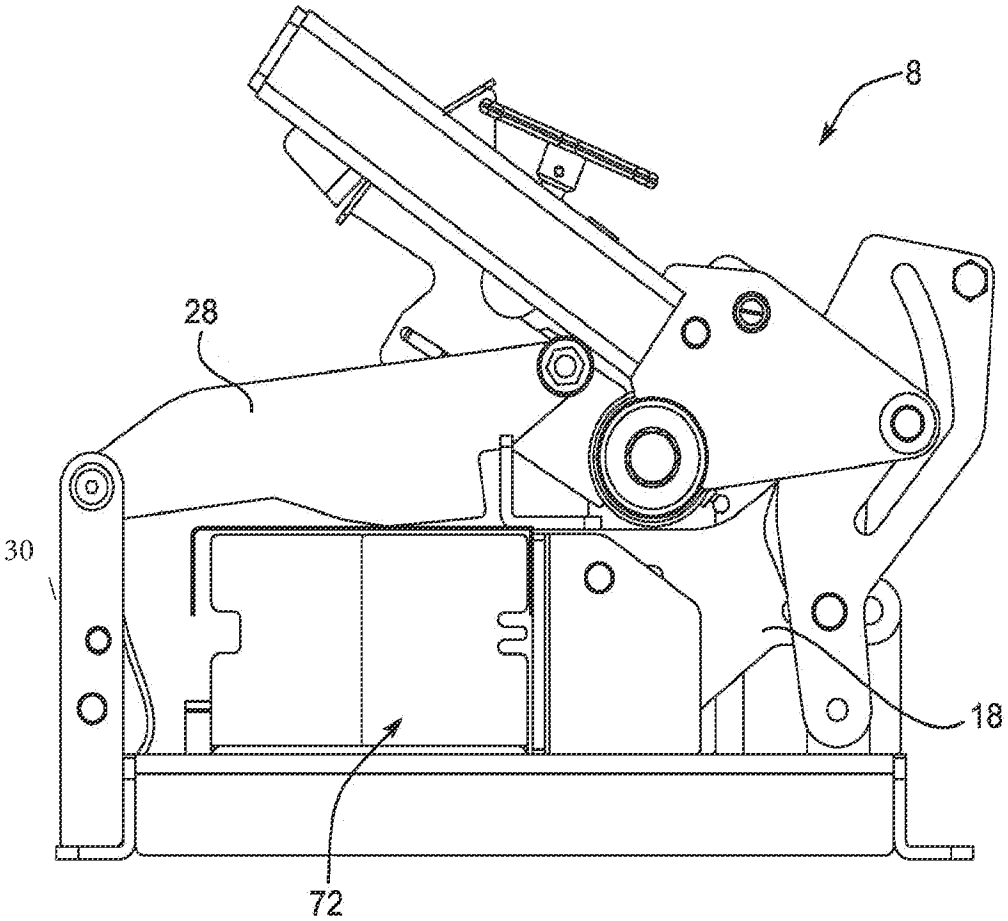
FIG. 3E is an end elevational view of the tool of the present invention preparing to perform the shaping operation to the workpiece.
Figure 3F:
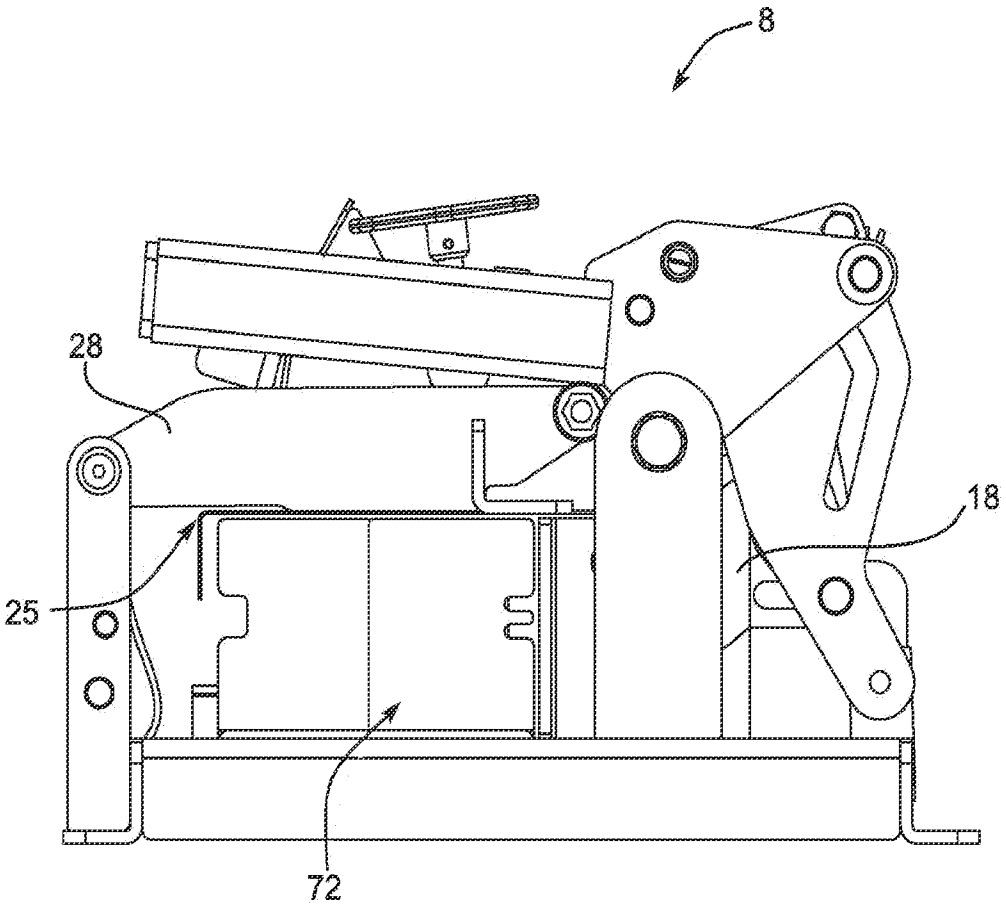
FIG. 3F is an end elevational view of the tool of the present invention performing a shaping operation to the workpiece.

To provide the selective repositionability of workpiece guides 90*a*, 90*b*, an attachment mechanism repositionably secures workpiece guide 90 to base 10. As illustrated in FIGS. 12-15, attachment mechanism 92 engages an elongate slot 94 oriented substantially parallel to width axis 3 (shown in FIGS. 1 and 2) in at least one of base 10 and workpiece guide 90. A shaft 96 of the attachment mechanism 92 is receivable through elongate slot 94, and a lock member 98 may be attached to shaft 96 for fixing a relative position of shaft 96 in elongate slot 94. In some embodiments, shaft 96 may be a bolt, such as a carriage bolt that extends through elongate slot 94, and secured thereat with a nut 98, such as a socket nut. A washer 99 may be used to space workpiece guide 90 from base 10. An aspect of the present invention is the accessibility of lock members 98 from upper region 4 of system 8. Where lock member 98 is a socket nut, a socket tool may engage therewith by extending through apertures 102 in upper side 91 of workpiece guide 90, which apertures 102 may be axially aligned with shaft 96, since shaft 96 may extend through corresponding apertures 104 in lower side 93 of workpiece guide 90. As a result, workpiece guides 90*a*, 90*b* may be loosened from tight engagement with base 10, and thereafter slidably repositioned along elongate slots 94 in a direction substantially parallel to width axis 3. Once repositioned, lock members 98 may be actuated to tightly secure workpiece guide 90 to base 10. Access to lock member 98, as described above, may be available from upper region 4 without the need to detach base 10 from substructure 5.

What is claimed is:

1. A system for shaping a workpiece, comprising:

a base having an upper side and a generally opposed lower side to separate an upper region coincident with the upper side from a lower region coincident with the lower side, and being securable to a substructure at the lower region;

a blade control apparatus;

a first indenting blade connected to the blade control apparatus for indenting a first portion of the workpiece when the workpiece is positioned in the upper region;

a second indenting blade connected to an upstanding support post member and controllable by the blade control apparatus for indenting a second portion of the workpiece when the workpiece is positioned in the upper region;

a handle connected to the blade control apparatus wherein the handle rotates about an axis to move the first indenting blade and the second indenting blade into indenting contact with the workpiece;

a master base plate having an upper surface and a lower surface with a plurality of first mounting features on the upper surface and a plurality of securement apertures on a side surface, wherein the master base plate is secured to the base adjacent the upstanding support post member below the second indenting blade so that the first mounting features of the master base plate are open to the upper region; and one or more removable workpiece support modules having two support module sides and a width, positionable on the upper surface of the master base plate, an elongated support module channel on an upper surface of the support module for receiving a fastener and aligned with the second indenting blade, and a second mounting feature configured to secure the one or more removable workpiece support modules to the upper surface of the master base plate, and wherein the elongated support module channel receives an indented portion of the workpiece when at least one of the first indenting blade and second indenting blade are moved into indenting contact with the workpiece.

2. The system of claim 1 wherein securement of one or more of the workpiece support modules to the master base plate creates a total width that corresponds to a workpiece width of the workpiece.

3. The system of claim 2 wherein the workpiece width is defined between opposed flanges of the workpiece, which flanges are connected together by a web.

4. The system of claim 3 wherein the workpiece support modules are securable to the master base plate in immediate adjacency to one another.

5. The system of claim 1 wherein the second mounting feature of the one or more removable workpiece support modules coordinates with one of the first mounting features of the master base plate.

6. The system of claim 5 wherein the first mounting features include receptacles, and the second mounting features include at least one of receptacles, apertures, and protrusions that are axially alignable with the receptacles of the first mounting features.

7. The system of claim 6 including fasteners for securing the workpiece support modules to the master base plate by extending through the respective apertures of the second mounting features, and into the respective receptacles of the first mounting features.

8. The system of claim 1 wherein a first one of the workpiece support modules is removably securable to the master base plate at a position adjacent to the first indenting blade, with a first side of the first workpiece support modules facing the first indenting blade having a first slot for receiving at least one of the first indented portion of the workpiece and the first indenting blade.

9. The system of claim 8 wherein the first side of the first workpiece support module includes a second slot for receiving a flange portion of the workpiece.

10. The system of claim 9 wherein a second side of the first workpiece support module facing generally oppositely from the master base plate includes a third slot for receiving at least one of the second indented portion of the workpiece and the second indenting blade.

11. The system of claim 10 wherein each of the workpiece support modules includes a slot for receiving at least one of the second indented portion of the workpiece and the second indenting blade.

12. The system of claim 1 wherein the master base plate is integrally formed with the base.

13. A method for shaping a workpiece with the shaping system of claim 1, the method comprising:

(a) selecting one or more of the workpiece support modules from a set of workpiece support modules;

(b) securing the selected ones of the workpiece support modules to the master base plate;

(c) positioning the workpiece in the upper region at the selected ones of the workpiece support modules; and (d) actuating the handle to move the first and second indenting blades with respect to the base and into indenting contact with the workpiece.

14. The method of claim 13 wherein the first indenting blade is moved into indenting contact with the workpiece to form an indent in the first portion of the workpiece, and the second indenting blade is moved into indenting contact with the workpiece to form an indent in the second portion of the workpiece.

15. The method of claim 14 wherein the first portion is perpendicular to the second portion.

16. The method of claim 13 including replacing at least one of the workpiece support modules with another of the workpiece support modules of the set of workpiece support modules by removing the at least one of the workpiece support modules from the master base plate and positioning another workpiece support module onto the first mounting features of the master base plate.

* * * * *